US005181291A

United States Patent [19]

Eairheart

[11] Patent Number: 5,181,291

[45] Date of Patent: Jan. 26, 1993

[54] PAD SUPPORT ASSEMBLY FOR FLOOR POLISHING MACHINE

[76] Inventor: Daniel L. Eairheart, 1323 Begonia, O'Fallon, Mo. 63366

[21] Appl. No.: 682,662

[22] Filed: Apr. 9, 1991

[51] Int. Cl.[5] ..... A47L 11/14; A47L 11/40

[52] U.S. Cl. ..... 15/98; 15/230; 15/230.17

[58] Field of Search ..... 15/97.1, 98, 230, 230.12, 15/230.14, 230.16–230.19; 51/170 T, 177

[56] References Cited

U.S. PATENT DOCUMENTS

| | | | |
|---|---|---|---|
| 4,307,480 | 12/1981 | Fallen | 15/230.18 |
| 4,809,385 | 3/1989 | Bogue | 15/230.19 |
| 4,845,798 | 7/1989 | Genovese | 15/98 |

*Primary Examiner*—Edward L. Roberts

*Attorney, Agent, or Firm*—Haverstock, Garrett & Roberts

[57] ABSTRACT

A pad support assembly for supporting a buffing pad on a floor buffing machine including a pad support member of disk-like construction having a central overhead portion, an annular peripheral portion for engaging the peripheral portion of a pad positioned therein, and a portion connected therebetween, and a pad retainer plate for attaching to the central overhead portion of the pad support member to press a pad therebetween. The pad support assembly may also include an air impervious layer of material positioned between the pad and the peripheral portion of the pad support member so that air cannot flow down into the pad from above should a portion of the pad separate from the peripheral portion of the pad support member due to an irregularity in the floor being buffed. The pad support member should also be constructed so as to prevent air flow therethrough.

21 Claims, 2 Drawing Sheets

PAD SUPPORT ASSEMBLY FOR FLOOR POLISHING MACHINE

BACKGROUND OF THE INVENTION

This invention relates to devices for polishing floors and in particular to a pad support assembly for a circular floor buffing pad.

Floor buffing or polishing machines are used for the care and maintenance of floors in commercial settings such as supermarkets, stores, office buildings, and institutions. These floor polishing machines are typically electrically powered and include a drive shaft for rotating a circular buffing pad. Over the years floor polishing machines have progressed from heavy, clumsy machines that could drive the buffing pad at 150 to 250 revolutions per minute (RPM), to what was once known as high speed machines turning at about 350 RPM, and to the present ultra high speed machines capable of producing speeds of 1000, 1500, 2000, and even 3500 RPM. Although the present ultra high speed machines are useful, there are some associated problems.

One problem associated with the use of ultra high speed machines is due to the amount of outwardly blowing wind created by the rotating buffing pad. The wind produced by the rotating pad is sufficient to blow papers off desks and light merchandise off shelves, and to generate dust and dirt. A 22 inch diameter buffing pad is capable of rotating at 2000 revolutions per minute and has a circumference speed of approximately 135 miles per hour and is capable of producing wind in volumes relative to the pad thickness at that velocity. The wind from such a rotating buffing pad is created not only by the outside edge turbulance but more importantly by air passing through the fibers of the pad in much the same manner as a centrifugal fan or squirrel cage fan. In such a device air is allowed to enter from above and below the pad to be thrown out the sides of the pad due to the centrifugal force created by the spinning action of the pad. Prior art devices, such as those disclosed in Fallen U.S. Pat. No. 4,307,480 and Bogue U.S. Pat. No. 4,809,385 suffer from this same difficiency because both these prior art devices allow air to flow into the pad from above and below.

Another problem associated with the use of ultra high speed machines is that sufficient weight is not placed on the pad for the pad to productively buff a floor surface. The older low speed polishing machines had the entire weight of the motor frame and the handle directly over the pad. Gear reduction mechanisms were necessary to reduce the speed at which the pad was rotated due to the heavy weight on the pad. Newer ultra high speed machines have a lower gear reduction ratio so the manufacturers have added wheels to support the majority of the weight of the machine. With less weight on the pad, the productivity of the machine, which uses the same pad driver design as in the older machines, is therefore decreased. Manufacturers of the ultra high speed machines have recommended that the machines be tilted to put most of the pressure on the front portion of the pad which is in contact with the floor. This is necessary due to the motor not having sufficient power to turn the pad at a higher speed if the entire periphery of the pad engages the floor. However, this method causes premature wear of the pad and presents a small buffing surface of the pad to the floor.

Still another problem associated with the use of ultra high speed polishing machines is that the buffing pads have a tendency, due to drag, to reduce the rotational speed of the machine. The slower speed of the machine reduces the size of the area which can be buffed at a particular time and requires additional passes of the machine over the area. In order to solve this problem various prior art devices, such as those disclosed in Fallen and Bogue, disclose a pad support structure which reduces the area of the buffing pad which contacts the floor to a relatively narrow peripheral annulus of the pad. Although these devices allow less drag there are other problems associated with using these devices, such as uneven and premature pad wear. Also, the contact surface of the pad by the support structure does not support the pad evenly. This results in premature wear of the pad when using these prior art devices especially directly below the teeth which engage the pad. As the pad becomes thinner, less pressure is placed on the pad material at the outside edge of the pad and this causes less of the pad to be in contact with the floor to be buffed. More passes of the pad are then required to buff the floor and more importantly additional operator time is required.

The present invention is designed to obviate and overcome many of the disadvantages and shortcomings experienced with the pad support structures hereinbefore discussed and with other pad support structures used in the past.

SUMMARY OF THE INVENTION

A pad support assembly of the present invention is designed and intended for use with a circular floor buffing pad with the assembly and pad adapted to be rotated by a high speed floor buffing machine. For the pad to buff a floor, the assembly comprises a pad support member including a disk-like member having a central overhead portion, an annular peripheral portion for engaging the peripheral portion of the buffing pad, and wall means connecting the overhead and peripheral portions, the pad support member forming a closed configuration preventing any air flow therethrough, and a pad retaining plate including means for attaching the retaining plate to the overhead portion of the disk-like member with the pad positioned therebetween, the pad retaining plate covering a portion of the pad to further prevent air flow therethrough, the peripheral portion of the disk-like member pressing down on the peripheral portion of the pad during a buffing operation to place the peripheral portion of the pad into contact with the floor. With the pad mounted on the underside of the pad support member between the pad support member and the pad retaining plate air is prevented from flowing into the pad during a buffing operation.

In light of the foregoing comments, it will be recognized that a principal object of the present invention is to provide an improved pad support assembly for a floor polishing machine which reduces or substantially eliminates the amount of outwardly blowing wind produced by the rotating pad.

Another object of the invention is to provide a pad support assembly for a floor polishing machine which substantially prevents uneven and premature wear of the pad.

A further object of the invention is to provide a pad support assembly for a floor polishing machine which is of relatively simple construction and design, is easy to install and use, and produces better and more reliable polishing results.

A still further object of the invention is to provide a pad support assembly for a floor polishing machine which is relatively inexpensive to produce and to use.

Another object of the invention is to provide a pad support assembly for a floor polishing machine which does not require substantial modification of existing floor polishing machines.

Yet another object of the invention is to provide a pad support assembly for a floor polishing machine which places the weight of the assembly on the outer edge of the pad which is the portion in contact with the floor to increase pressure per square inch around the edge portion of the pad. The increased pressure per square inch in combination with the high speed of rotation of the pad produces heat to activate chemicals in modern floor finishes.

These and other objects and advantages of the present invention will become apparent after considering the following detailed specification of a preferred embodiment in conjunction with the accompanying drawings, wherein:

DETAILED DESCRIPTION OF THE PREFERRED EMBODIMENTS

Figure 1:
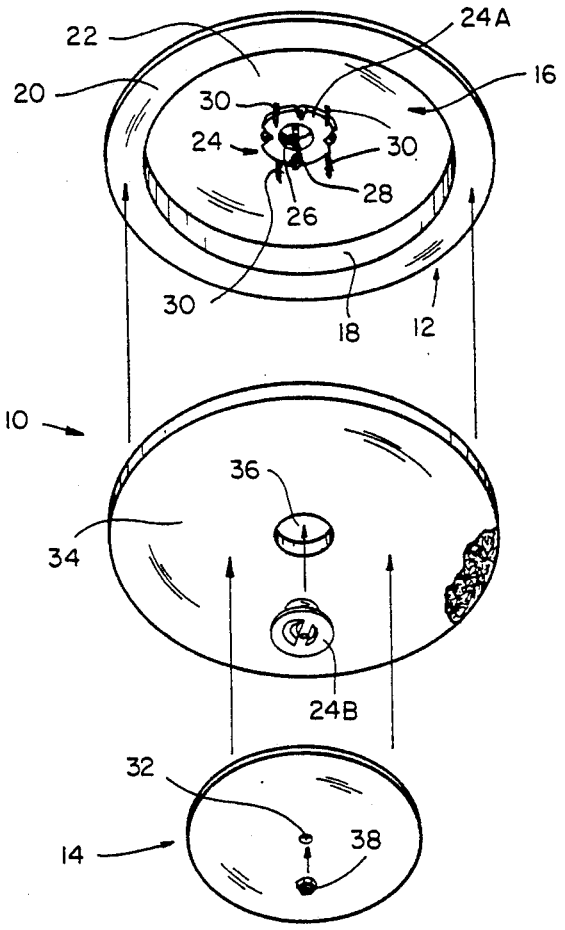
FIG. 1 is an exploded perspective view of the pad support assembly according to the present invention.

Referring now to the drawings and in particular to FIG. 1, wherein like numerals refer to like items, a preferred embodiment of a pad support assembly 10 of the present invention is shown to include a pad support member 12 and a pad retaining plate 14. The pad support member 12 includes a disk-like member having a central overhead portion 16 connected to a depending tubular wall portion 18. An annular peripheral rim 20 extends outwardly from the lower edge of the wall 18. The pad support member 12 forms an air tight chamber to prevent air from passing therethrough to the pad. The disk portion 16 has an interior surface or underside 22 with A centrally located collar 24 having a first portion 24A secured to the underside 22 by any suitable means, for example screws and a second portion 24B which screws into the first portion 24A to form the collar 24. A bolt 26 having a threaded end 28 extends down through an opening in the collar 24. The pad support member 12 also includes a plurality of spaced pins 30 having pointed ends which extend down from the underside 22 of the pad support structure 12.

The pad retaining plate 14 is disk shaped and has a centrally located aperture 32 which is adapted to receive therethrough the threaded end 28 of the bolt 26. A flexible circular buffing or polishing pad 34 is placed between the pad support member 12 and the pad retaining plate 14. The pad 34 has a central aperture 36 through which the collar 24 and the bolt 26 pass. A lock nut 38 is secured to the threaded end 28 of the bolt 26 to secure the retaining plate 14 and the pad 34 in position when the pad support assembly 10 is assembled. The pad retaining plate 14 covers most of the central area of the pad 34 from below and therefore functions to block or reduce airflow upwardly into the pad 34. This is important as will be explained.

Figure 2:
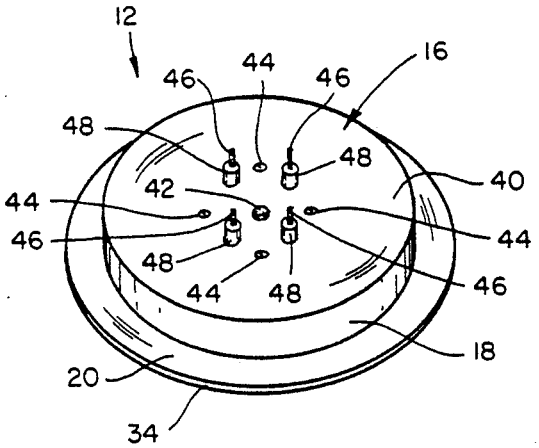
FIG. 2 is a top perspective view of the pad support assembly shown in FIG. 1.

FIG. 2 is a perspective view of the top of the pad support member 12. The disk 16 has an upperside 40 opposite to that of the underside 22. A head 42 of the bolt 26 projects from the upperside 40 of the disk 16 and may be fixedly attached thereto. Heads 44 of the spaced pins 30 are also shown positioned against the upperside 40 of the disk 16. A plurality of upwardly extending bolts 46 having spacers 48 thereon are also provided for attaching the assembly to a floor buffing machine as will be explained.

Figure 3:
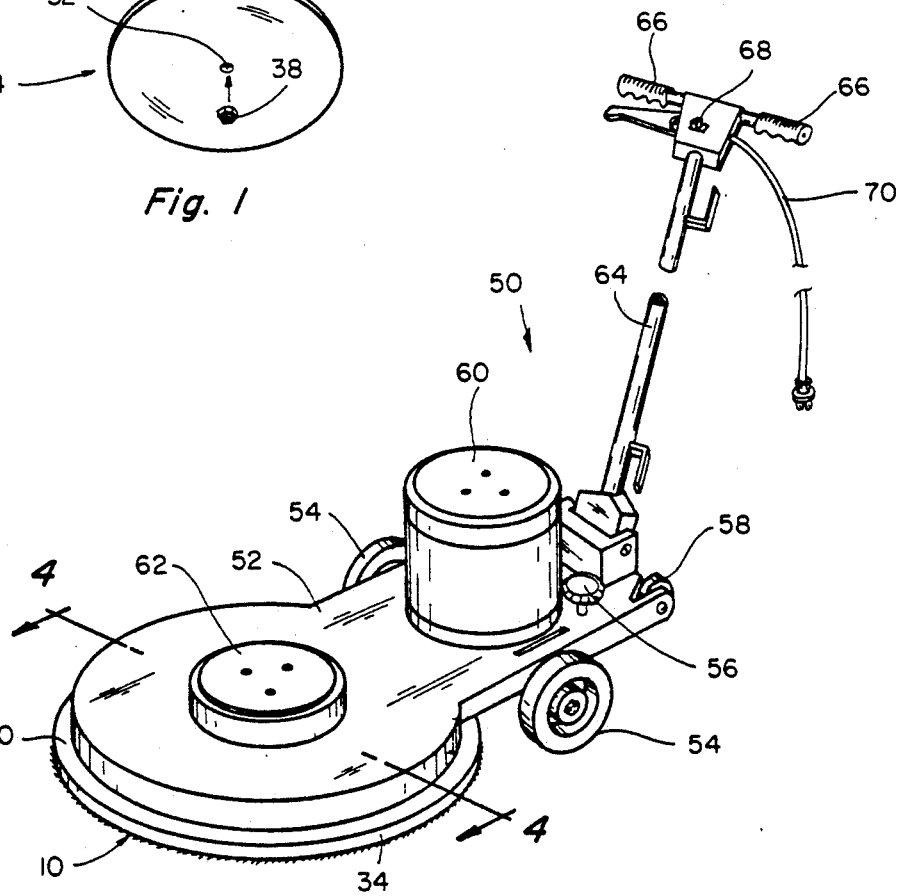
FIG. 3 is a perspective view of a floor polishing machine including a preferred embodiment of the pad support assembly shown in FIG. 1.

A floor polishing machine 50 is shown receiving the fully assembled pad support assembly 10 in FIG. 3. The floor polishing machine 50 rotates the pad support assembly 10 and the pad 34 in order for the pad 34 to polish or buff a floor. With the pad 34 in contact with the floor no air is able to enter into the pad 34 from either above or below the pad 34 but the vacuum produced in the pad holds the pad against the floor and against the rim portion 20. The floor polishing machine 50 has a main body 52 which has a pair of adjustable wheels 54 connected thereto. The adjustable wheels 54 support the machine 50 when it is moved over the floor during a polishing operation. Vertical adjustment of positions of the wheels 54 is controlled by a knob 56 which is used to adjust the position of the main body 52 and the pad relative to the floor and some adjustment may be necessary as the pad 34 wears down. A pair of rear wheels 58 are also provided to help manuever the machine 50 when going over curbs or other high surfaces.

A motor, such as electric motor 60, is mounted to the main body 2 an when activated turns a drive belt connected to a pulley assembly 62 which in turn rotates the pad support assembly 10 and the pad 34. An operator handle 64 is connected at one end to the main body 52 and the operator handle 64 has a pair of hand grips 66, a power switch 68, and a power cord 70 attached thereto.

Figure 4:
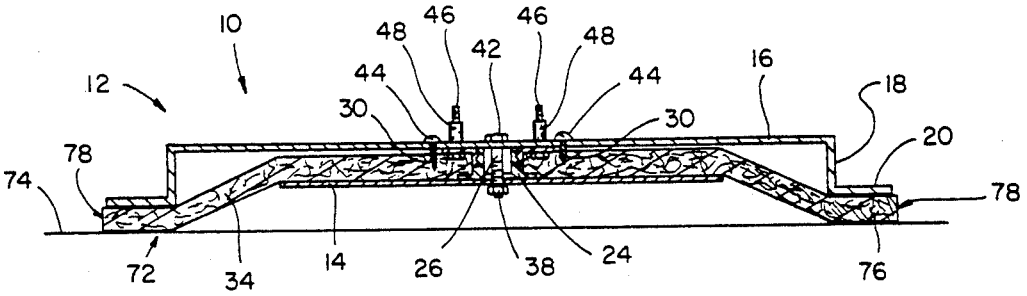
FIG. 4 is an enlarged cross-sectional view taken along the plane of line 4—4 of FIG. 3.
Figure 5:
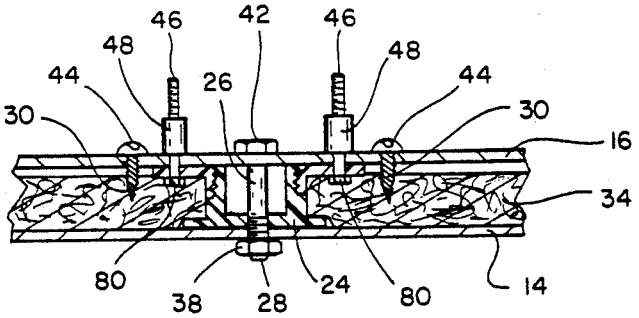
FIG. 5 is a further enlarged fragmentary cross-sectional view of the central portion of the pad support assembly of FIG. 4.

Referring now to FIGS. 4 and 5, the pad support assembly 10 is shown fully assembled with the pad 34 positioned over the collar 24 and the bolt 26 and held in place by the pad retaining plate 14 secured by the lock or wing nut 38 threaded onto the threaded end 28 of the bolt 26. The pad 34 is also held in place by the collar portion 24B and the pointed ends of the pins 3 which dig into and grip the pad 34. The pad 34 has a floor engaging face 72 which is in contact with a floor 74 when in use. Typically, only an outer peripheral portion 76 of the pad 34 engages the floor 74 during a buffing operation, and it has been found that it is engagement of only this outer portion 76 with the floor that produces the desired buffing condition. The peripheral pad portion 76 is preferably substantially the same in area as the area below the rim 20. The rim 20 therefore supports the outer portion 76 of the pad 34 uniformly around its periphery and presses the pad 34 into engagement with the floor 74. This has the effect of sealing the pad from airflow therethrough which otherwise might enter into the pad 34 especially if there were openings or orifices in the member 12. This has also been found to increase pad life and productivity of the polishing machine 50 and reduces uneven pad wear. The suction produced in the peripheral portion of the pad 34 during operation also holds the pad engaged with the floor and with the rim portion 20 of the support member 12.

Most of the remainder of the pad 34 is sandwiched between the retaining plate 14 and the disk 16. The retaining plate 14, when secured by the nut 38 is shown to be spaced above the rim 20 so as not to be able to contact the floor. This insures that the outer portion 76 of the pad 34 is the only portion of the pad 34 which contacts the floor 74 and the outer portion 76 therefore preferrably runs flat or nearly flat on the floor 74. The outer portion 76 presents the polishing surface of the pad uniformly to the floor. Prior machines would only present one portion of the polishing surface to the floor due to the requirement of tilting the floor polishing machine. The titling of the machine therefore usually also required more passes of the machine to polish a given area.

It is important to note that there is no airflow from the interior of the pad support member 12 out through the pad 34 or an edge 78 of the pad 34 due to the pad support member 12 being air tight and sealed or pressed to the plate 14. The plate 14 also prevents airflow from coming up from the floor 74 into the pad 34. This reduces the amount of wind, dust, and dirt thrown outwardly during rotation of the pad 34. Additionally, the fact that the rim 20 presses down on the outer pad portion 76 further reduces or limits the amount of air flowing through the pad 34.

As illustrated in FIG. 5, the bolts 46 extend from their head ends 80 which are held in place against the underside 22 of the member 16. The washers 48 are threaded or slid onto the bolts 46 and the bolts are threaded into the pulley assembly 62 on the buffing machine so that the assembly 10 can rotate therewith. The washer 48 provides the necessary clearance to make uniform planar rotation possible. In order to install or remove and replace the pad 34 it is only necessary to remove the nut 38 and the retainer plate 14.

The pad support assembly 10 is sized to be fit within the main body 52 of the buffing machine 50, as shown in FIG. 3. The floor polishing machine 50 is activated by the operator when plugged in by turning on the switch 68. The electric motor 60 turns the drive belt, the pulley assembly 62 and the pad support assembly 10. The pad 34 rotates at high speeds and when moved against the floor 74 polishes or buffs the floor. The pad also creates a vacuum condition especially in its peripheral portion which holds the pad against the floor and also holds the pad against the rim 20. In the event the pad engages an uneven portion of the floor the peripheral portion of the pad will remain engaged with the floor and the upper surface of the pad will preferably remain engaged with an optional overhead member as will be described. The vacuum created by the rotating pad also sucks dirt up into the pad. Additionally, the vacuum created by the rotating pad reduces movement of the floor polishing machine in the event the operator lets go of the machine. Therefore, there are four benefits to the vacuum condition created by the rotating pad, namely, the peripheral portion of the pad is held to the floor, the peripheral portion of the pad is held to the rim 20, the rotating pad sucks up dirt into the pad, and movement of the floor polishing machine is reduced when not held by the operator.

Figure 6:
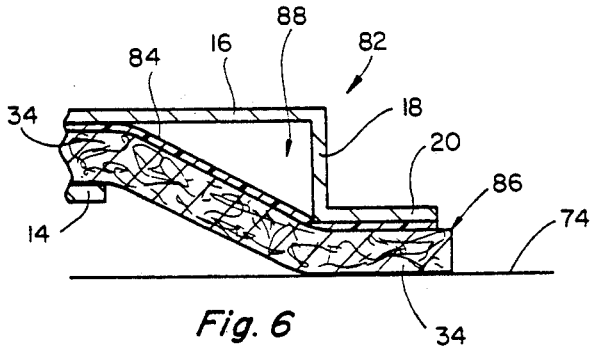
FIG. 6 is another fragmentary cross-section view showing a second embodiment of a pad support assembly according to the present invention.

FIG. 6 shows a second embodiment of a pad support assembly 82, the principle difference being the addition of an air impervious skirt or layer 84 placed on a top surface 86 of the pad 34. The skirt 84 prevents air from entering the pad 34 from the top and from cavity 88. This is especially important should the pad 34 separate from the rim 20 at some location due to engaging an uneven portion of the floor. The cavity 88 is defined by the area bounded by the pad 34, the underside 22 of the disk 16, and the ring 18. The skirt 84 may be separate from the pad 34 and removable from the pad support assembly 82 or the pad can be attached to the pad. The skirt 84 includes a central hole (not shown) through which the collar 24 and the bolt 26 pass. Holes (not shown) for receiving the pins 30 may also be provided in the skirt 84. The skirt 84 may be constructed of any flexible durable air impervious material such as plastic, canvas, reinforced rubber, or leather and the skirt may have high frictional characteristics to prevent the pad from slipping on the support structure. The other parts of the pad support assembly 82 are similar to the pad support assembly 10. If the machine is buffing on an uneven floor so that the pad moves away from the rim 20 at some location the suction produced will hold the pad against the floor and the layer 84 against the pad. This prevents air from going out from the pad.

Figure 7:
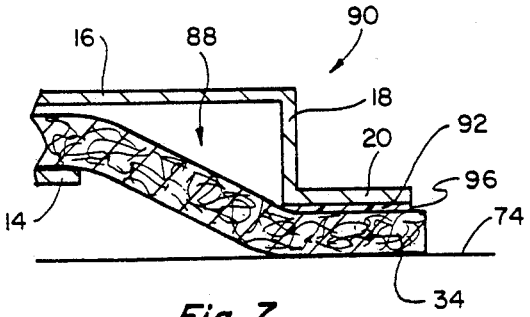
FIG. 7 is a fragmentary cross-sectional view of a third embodiment of a pad support assembly according to the present invention.

A third embodiment of a pad support assembly 90 is shown in FIG. 7 to includes an annular strip 92 which is attached to the underside 96 of the rim portion 20. The strip 92 helps to prevent air from entering into the cavity 88 and also provides a gripping action between the pad and the rim portion 20. The strip 92 may be a permanent part of the pad support assembly 90 or it may be attached to the pad although this is usually not preferred. The strip 92 may be constructed of any suitable material, such as plastic, canvas, reinforced rubber, leather or like substances. The other parts of the pad support assembly 90 are likewise similar to the pad support assembly 10.

From all that has been said, it will be clear that there has thus been shown and described herein a rotating pad assembly which fulfills the various objects and advantages sought therefor. It will be apparent to those skilled in the art, however, that many changes, modifications, variations, and other uses and applications of the subject pad support assembly are possible and contemplated. All such changes, modifications, variations, and other uses and applications which do not depart from the spirit and scope of the invention are deemed to be covered by the invention, which is limited only by the claims which follow.

What is claimed is:

1. A pad support assembly for use with a circular floor buffing pad with the assembly and pad adapted to be rotated by a floor buffing machine for the pad to buff a floor, the assembly comprising:

a pad support member including a disk-like member having a central overhead portion, an annular peripheral portion downwardly spaced from the overhead portion for engaging the peripheral portion of the buffing pad, and wall means connecting the overhead and peripheral portions, the pad support member having a continuous uninterrupted construction so as to prevent air flow therethrough; and a pad retaining plate including means for attaching the retaining plate to the underside of the overhead portion of the disk-like member with the pad positioned therebetween, the pad retaining plate being of continuous uninterrupted construction and covering a central portion of the pad to prevent air flow therethrough, the peripheral portion of the disk-like member engaging and pressing down on the peripheral portion of the pad during a buffing operation in a manner to prevent air flow between the peripheral portion of the disk-like member and the upper surface of the pad, and the peripheral portion of the disk-like member pressing down on the peripheral portion of the pad during a buffing operation to place the peripheral portion of the pad into contact with the floor.

2. The pad support assembly of claim 1 wherein the means for attaching includes a bolt extending from the central portion of the pad support member to an opposite threaded end, and a lock nut for threading on the threaded end to secure the central portion of the pad between the pad retaining plate and the pad support member.

3. The pad support assembly of claim 2 wherein the pad retaining plate is a circular disk having a central aperture for receiving the bolt therethrough.

4. The pad support assembly of claim 1 including means on the pad support member for gripping the pad.

5. The pad support assembly of claim 4 wherein the means for gripping include a plurality of spaced pins extending downwardly from a central position of the overhead portion to prevent the pad from turning relative thereto.

6. A pad support assembly for use with a buffing pad, the assembly and the pad adapted to be rotated by a floor polishing machine, the assembly comprising:

a pad support member including a disk-like member having a central overhead portion, an annular peripherial portion downwardly spaced from the overhead portion for engaging the peripheral portion of the buffing pad, and wall means connecting the overhead and peripheral portions, the pad support member forming a substantially closed wall configuration preventing air flow therethrough;

a pad retaining plate including means for attaching the retaining plate to the underside of the overhead portion of the disk-like member with the pad positioned therebetween, the peripheral portion of the disk-like member pressing down on the peripheral portion of the pad during a buffing operation to place the peripheral portion of the pad into contact with a floor; and means for preventing air flow through the pad whenever the pad separates from the peripheral portion of the disk-like member during a buffing operation.

7. The pad support assembly of claim 6 wherein the means to prevent air flow includes a layer of air impervious material positioned between annular peripheral portion of the pad and the annular peripheral portion of the disk-like member.

8. The pad support assembly of claim 7 wherein the layer of air impervious material is ring shaped and generally the same size as the annular peripheral portion fo the disk-like member.

9. The pad support assembly of claim 7 wherein the layer of air impervious material is constructed of a flexible material.

10. The pad support assembly of claim 6 wherein the means to prevent air flow includes a layer of material having a size and shape that is the same as the size and shape of the pad on one side.

11. The pad support assembly of claim 10 wherein the attaching means comprises a bolt having a threaded end, the bolt extending downwardly from an interior surface of the overhead portion and a lock nut for threading on the threaded end and the skirt includes a central hole through which the bolt passes.

12. The pad support assembly of claim 10 wherein the skirt is constructed of a flexible air tight material.

13. The pad support assembly of claim 6 wherein the peripheral portion of the pad is substantially equal to the annular peripheral portion of the pad support member.

14. The pad support assembly of claim 6 wherein when the pad retaining plate is positioned above the annular peripheral portion the pad retaining plate does not contact the floor during a buffing operation.

15. In a relatively high speed floor buffing machine having a housing supported on spaced wheels, a drive motor, a cavity for a rotatable pad support assembly and means in the cavity for attaching the pad support assembly for rotation by the drive motor, the improvement comprising:

a pad support member including means for attaching the member to the means in the cavity whereby the member and the pad attached thereto can rotate in the cavity, said member having a central overhead portion and a peripheral portion downwardly spaced from the overhead portion and attached to the overhead portion by an annular wall portion that extends therebetween, the pad support member having a continuous uninterrupted construction so as to prevent air flow therethrough, means including a disk member including means for attaching said disk member to the underside of the overhead portion so as to compress a central portion of the buffing pad between the disk member and the overhead portion with the uncompressed peripheral portion of the pad extending outwardly to the peripheral portion of the pad support member whereby the peripheral pad portion is pressed downwardly against a floor to be buffed during a buffing operation, the peripheral portion of the pad support member engaging and pressing down on the peripheral pad portion during a buffing operation in a manner to prevent air flow between the peripheral portion of the pad support member and the upper surface of the peripheral pad portion, and means on the housing to adjust the position of the spaced wheels thereon to adjust the height of the housing of the buffing machine to a position so the peripheral portion of the pad support member engages the pad relatively uniformly over the area thereof and presses the peripheral portion of the pad relatively uniformly over the periphery thereof against the floor being buffed.

16. In the floor buffing machine of claim 15 wherein the member and pad are rotated fast enough to produce a vacuum condition in the peripheral portion of the pad which causes the peripheral portion of the pad to be held engaged with the floor being buffed over substantially the entire area of the peripheral pad portion and causes the peripheral portion of the pad to be held engaged with the peripheral portion of the member, and the vacuum condition causes dirt to be sucked up into the pad instead of building up on the surface of the pad so that the surface portion of the pad retains cleaner.

17. In the floor buffing machine of claim 15 wherein the disk member is constructed to prevent air passage therethrough.

18. A pad support assembly for use with a circular floor buffing pad with the assembly and pad adapted to be rotated by a floor buffing machine for the pad to buff a floor, the assembly comprising:

a pad support member including a disk-like member having a central overhead portion, an annular peripherial portion downwardly spaced from the overhead portion for engaging the peripheral portion of the buffing pad, and wall means connecting the overhead and peripheral portions, the pad support member having a continuous uninterrupted construction so as to prevent air flow therethrough; a pad retaining plate including means for attaching the retaining plate to the underside of the overhead portion of the disk-like member with the pad positioned therebetween, the pad retaining plate being of continuous uninterrupted construction and covering a central portion of the pad to prevent air flow therethrough, the peripheral portion of the disk-like member pressing down on the peripheral portion of the pad during a buffing operation to place the peripheral portion of the pad into contact with the floor; and a layer of air impervious material positioned between the peripheral portion of the support member and the peripheral portion of the pad.

19. The pad support member of claim 18 wherein the layer of air impervious material extends substantially over one entire side of the pad.

20. In a relatively high speed floor buffing machine having a housing supported on spaced wheels, a drive motor, a cavity for a rotatable pad support assembly and means in the cavity for attaching the pad support assembly for rotation by the drive motor, the improvement comprising:

a pad support member including means for attaching the member to the means in the cavity whereby the member and the pad attached thereto can rotate in the cavity, said member having a central overhead portion and a peripheral portion downwardly spaced from the overhead portion and attached to the overhead portion by an annular wall portion that extends therebetween, the pad support member having a continuous uninterrupted construction so as to prevent air flow therethrough;

means including a disk member including means for attaching said disk member to the underside of the overhead portion so as to compress a central portion of the buffing pad between the disk member and the overhead portion with the uncompressed peripheral portion of the pad extending outwardly to the peripheral portion of the pad support member whereby the peripheral pad portion is pressed downwardly against a floor to be buffed during a buffing operation;

means on the housing to adjust the position of the spaced wheels thereon to adjust the height of the housing of the buffing machine to a position so the peripheral portion of the pad support member engages the pad relatively uniformly over the area thereof and presses the peripheral portion of the pad relatively uniformly over the periphery thereof against the floor being buffed;

a layer of air impervious material positioned extending between the peripheral portion of the pad and the peripheral portion of the member; and wherein the member and pad are rotated fast enough to produce a vacuum condition in the peripheral portion of the pad which causes the peripheral portion of the pad to be held engaged with the floor being buffed over substantially the entire area of the peripheral pad portion and causes the peripheral portion of the pad to be held engaged with the peripheral portion of the member, and the vacuum condition causes dirt to be sucked up into the pad instead of building up on the surface of the pad which surface thereby remains relatively cleaner.

21. In a relatively high speed floor buffing machine having a housing supported on spaced wheels, a drive motor, a cavity for a rotatable pad support assembly and means in the cavity for attaching the pad support assembly for rotation by the drive motor, the improvement comprising:

a pad support member including means for attaching the member to the means in the cavity whereby the member and the pad attached thereto can rotate in the cavity, said member having a central overhead portion and a peripheral portion downwardly spaced from the overhead portion and attached to the overhead portion by an annular wall portion that extends therebetween, the pad support member having a continuous uninterrupted construction so as to prevent air flow therethrough;

means including a disk member including means for attaching said disk member to the underside of the overhead portion so as to compress a central portion of the buffing pad between the disk member and the overhead portion with the uncompressed peripheral portion of the pad extending outwardly to the peripheral portion of the pad support member whereby the peripheral pad portion is pressed downwardly against a floor to be buffed during a buffing operation;

means on the housing to adjust the position of the spaced wheels thereon to adjust the height of the housing of the buffing machine to a position so the peripheral portion of the pad support member engages the pad relatively uniformly over the area thereof and presses the peripheral portion of the pad relatively uniformly over the periphery thereof against the floor being buffed;

a layer of air impervious material positioned extending between the pad and the member; and wherein the member and pad are rotated fast enough to produce a vacuum condition in the peripheral portion of the pad which causes the peripheral portion of the pad to be held engaged with the floor being buffed over substantially the entire area of the peripheral pad portion and causes the peripheral portion of the pad to be held engaged with the peripheral portion of the member, and the vacuum condition causes dirt to be sucked up into the pad instead of building up on the surface of the pad which surface thereby remains relatively cleaner.

* * * * *

UNITED STATES PATENT AND TRADEMARK OFFICE

CERTIFICATE OF CORRECTION

PATENT NO. : 5,181,291
DATED : January 26, 1993
INVENTOR(S) : EAIRHEART

It is certified that error appears in the above-indentified patent and that said Letters Patent is hereby corrected as shown below:

Column 4, line 46, "an" should be --and --.
line 46, "2" should be --52 --.
Column 9, line 4, "retains" should be --remains --.

Signed and Sealed this

First Day of March, 1994

Bruce Lehman

*Attest:*

BRUCE LEHMAN

*Attesting Officer*

*Commissioner of Patents and Trademarks*